US006385854B1

(12) United States Patent
Sisco

(10) Patent No.: US 6,385,854 B1
(45) Date of Patent: May 14, 2002

(54) FIRE FIGHTING TOOL FOR MAKING A HOLE IN A CEILING

(75) Inventor: Bob Sisco, E. Hanover, NJ (US)

(73) Assignee: Robert Sisco, East Hanover, NJ (US)

( * ) Notice: Subject to any disclaimer, the term of this patent is extended or adjusted under 35 U.S.C. 154(b) by 0 days.

(21) Appl. No.: 09/408,497

(22) Filed: Sep. 30, 1999

(51) Int. Cl.[7] ..... B26B 3/00
(52) U.S. Cl. ..... 30/340; 30/308.1; 294/26
(58) Field of Search ..... 30/320, 308.1, 30/298, 340, 123; 7/158, 159, 161, 170, 166, 168; 294/24, 26, 61

(56) References Cited

U.S. PATENT DOCUMENTS 580,949 A * 4/1897 Murphy ..... 294/26
2,325,227 A * 7/1943 Chaddock
3,921,288 A * 11/1975 Clemens ..... 294/26
4,287,623 A * 9/1981 Tarran ..... 7/158
4,597,123 A * 7/1986 Cobe ..... 7/166 X
5,171,052 A * 12/1992 Cunningham ..... 294/26
5,261,164 A * 11/1993 Bellegante ..... 30/308.1

* cited by examiner

*Primary Examiner*—Douglas D. Watts

(57) ABSTRACT

A fire fighting tool for making a hole in a ceiling. The tool includes a body, a hook, and a handle. The body has a first terminal end and a second terminal end. The hook has a working area and is disposed on the first terminal end of the body and pierces the ceiling so as to form a piercing. The handle is pivotally mounted to the second terminal end of the body and has a normal position in which it extends perpendicularly outwardly from both sides of the body to assist in the piercing and a pivoted position in which it is pivoted against the body after the body has been inverted, with the handle then being inserted into the piercing in the ceiling and released away from the body back to its normal position to rest on a large area of the ceiling surrounding the piercing which is then pulled down to make the hole in the ceiling.

14 Claims, 1 Drawing Sheet

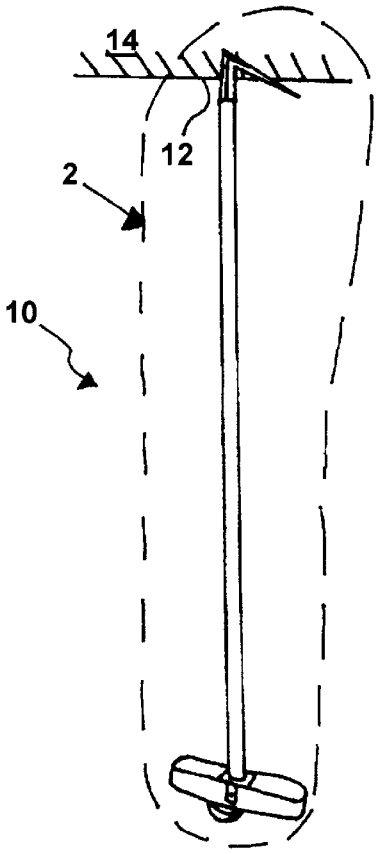
FIG. 1
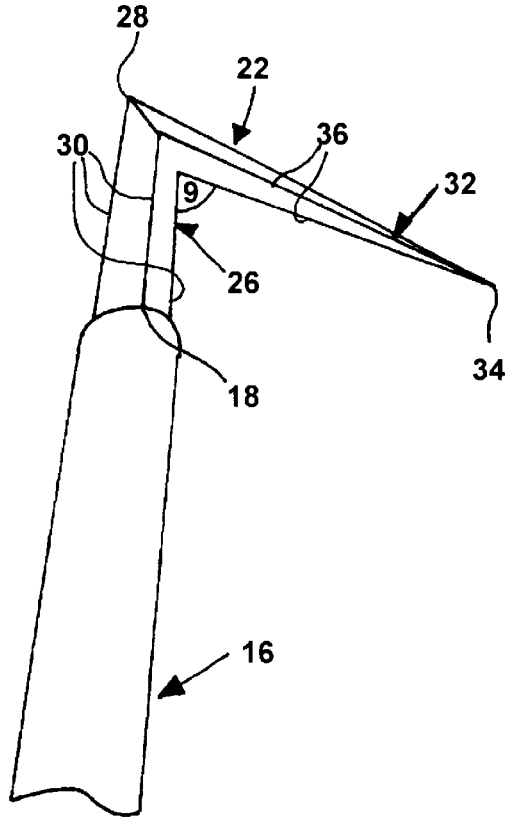
FIG. 2
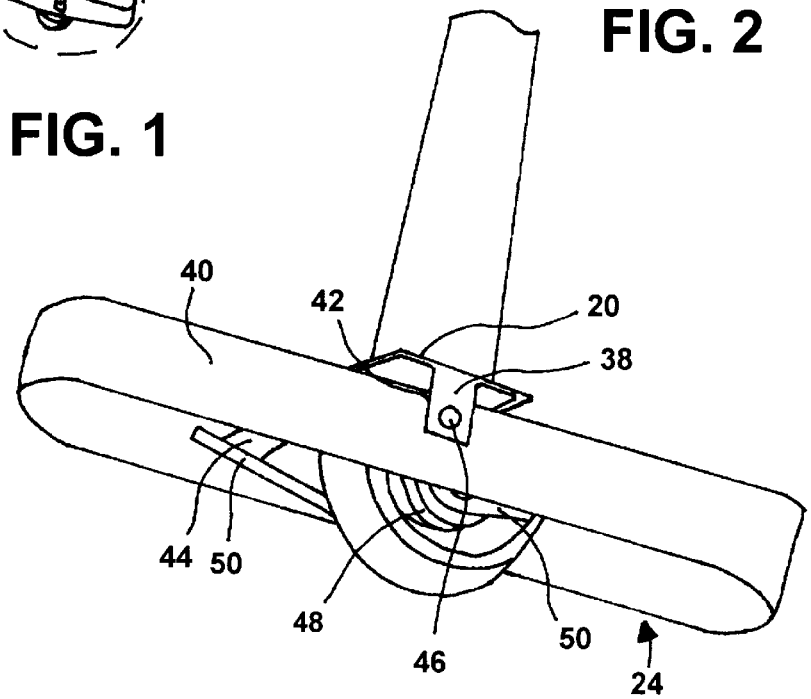

FIRE FIGHTING TOOL FOR MAKING A HOLE IN A CEILING

BACKGROUND OF THE INVENTION

1. Field of the Invention

The present invention relates to a fire fighting tool. More particularly the present invention relates to a fire fighting tool for making a hole in a ceiling.

2. Description of the Prior Art

The prior art of fire fighting devices include the so-called pike poles. A pike pole is generally provided with a straight sharpened piercing portion which is used to initially batter holes in ceilings and a hook-shaped portion that is spaced a short distance from the pointed portion and which is used to grip portions of the ceiling and pull it away to expose the fire within.

While these so-called pike poles have been used for a great length of time by fire fighters, they have been subject to some criticism because they are able to poke only a small hole in the ceiling and when the hook portion is used to pull the ceiling backwards oftentimes only a small portion of the ceiling breaks away because the hook portion is not large enough to contact a great enough area of the ceiling to permit a large opening to be made.

There exists therefore a need for a penetration and pulling tool that would enable fire fighters to remove large ceiling sections without having to make multiple penetrations therein.

Numerous innovations for fire fighting tools have been provided in the prior art that will be described. Even though these innovations may be suitable for the specific individual purposes to which they address however they differ from the present invention.

FOR EXAMPLE U.S. Pat. No. 3,921,288 to Clemens teaches a wrecking tool for piercing wall and ceiling surfaces and for enabling easy removal of sections thereof. The tool performs a number of functions, including piercing, chipping, prying, gouging, tearing, and also can be used as a lever for removing trim and for forcing open doors and doors.

ANOTHER EXAMPLE U.S. Pat. No. 4,208,793 to Sinnot teaches a fire fighting device for breaking holes in ceilings, walls, and the like. A battering and cutting edge extends downwardly from a pointed tip, and a horizontal or bottom blade extends perpendicular to the axis of an adapting means which is attached to the blade portion and to a pole for gripping by the fire fighter. The bottom blade includes a fulcrum spaced away from the tip a first distance and protruding below the bottom cutting edge to thereby allow the battering and cutting means to pivot securely for use in pulling down walls and removing sections of ceilings. The cutting blade is heavy gauge metal which includes a contoured portion that permits the pole-attached adapter to be nested therein for purposes of securely attaching the adapter to the cutting blade by a filler metal.

STILL ANOTHER EXAMPLE U.S. Pat. No. 5,095,623 to Williams teaches a fire fighting tool having a flat blade with a pointed leading end for piercing through structural panels, a plurality of stop teeth members for engaging a structural panel that has been pierced to defeat facile withdrawal of the tool, and a plurality of rib teeth members for sawing through the panels when the tool is reciprocated along its longitudinal axis. The stop teeth members are positioned at an angle relative to the rip teeth members and allow the fire fighter to easily maintain the tool in an overhead configuration when it is used to remove ceiling panels because the angle of the stop teeth members results in a hooking action so that the ceiling supports the weight of the tool to some extent. Since the stop teeth members defeat inadvertent withdrawal of the blade, the fire fighter need not make multiple penetrations of the ceiling panels or other structural member being removed by the tool.

YET ANOTHER EXAMPLE U.S. Pat. No. 5,542,183 to Allison teaches a fire fighter's tool for cutting through ceiling and wall panels which includes a base shaft within which telescoping expandable tubular sections are stored. The base shaft carries a power cord reel, counterbalance, and a control handle. A retractable power cord extends through the core of the extendable tubular sections to a motor mounted at the distal end of the outermost telescoping tubular section. The motor is encased within a waterproof enclosure and the shaft of the motor turns concentrically with the axis of the extendable tubular shafts. Gears and belt driving means connect the motor to a transverse shaft rotating a circular cutting blade on an axis perpendicular to the axis of the extendable tubes. The blade is provided with a pair of fan-like shields spring biased to substantially enclose the blade when it is not actively cutting, but which retract to expose the blade when slight pressure is applied thereto when the tool is in use.

It is apparent that numerous innovations for fire fighting tools have been provided in the prior art that are adapted to be used. Furthermore even though these innovations may be suitable for the specific individual purposes to which they address however they would not be suitable for the purposes of the present invention as heretofore described.

SUMMARY OF THE INVENTION

ACCORDINGLY AN OBJECT of the present invention is to provide a fire fighting tool for making a hole in a ceiling that avoids the disadvantages of the prior art.

ANOTHER OBJECT of the present invention is to provide a fire fighting tool for making a hole in a ceiling that is simple and inexpensive to manufacture.

STILL ANOTHER OBJECT of the present invention is to provide a fire fighting tool for making a hole in a ceiling that is simple to use.

BRIEFLY STATED YET ANOTHER OBJECT of the present invention is to provide a fire fighting tool for making a hole in a ceiling. The tool includes a body, a hook, and a handle. The body has a first terminal end and a second terminal end. The hook has a working area and is disposed on the first terminal end of the body and pierces the ceiling so as to form a piercing. The handle is pivotally mounted to the second terminal end of the body and has a normal position in which it extends perpendicularly outwardly from both sides of the body to assist in the piercing.

The novel features which are considered characteristic of the present invention are set forth in the appended claims. The invention itself however both as to its construction and its method of operation together with additional objects and advantages thereof will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of the present invention in use; and FIG. 2 is an enlarged diagrammatic perspective view of the area generally enclosed by the dotted curve identified by ARROW 2 in FIG. 1 of the present invention.

LIST OF REFERENCE NUMERALS UTILIZED IN THE DRAWING

α acute angle

10 fire fighting tool of the present invention for making hole 12 in ceiling 14

12 hole in ceiling 14

14 ceiling

16 body

18 first terminal end of body 16

20 second terminal end of body 16

22 hook for piercing ceiling 14

24 handle

26 first portion of hook 22

28 first point of first portion 26 of hook 22 for initially piercing ceiling 14

30 longitudinal edges of first portion 26 of hook 22 for facilitating piercing of ceiling 14

32 second portion of hook 22

34 second point of second portion 32 of hook 22

36 longitudinal edges of second portion 32 of hook 22 for further facilitating piercing of ceiling 16

38 fork of body 16

40 continuous loop of handle 24

42 midpoint of continuous loop 40 of handle 24

44 pair of cross members of handle 24 of handle 24

46 pivot pin of handle 24

48 coil spring of handle 24

50 pair of free ends of handle 24

DETAILED DESCRIPTION OF THE PREFERRED EMBODIMENT

Referring now to the figures, in which like numerals indicate like parts, and particularly to FIG. 1, which is a diagrammatic perspective view of the present invention in use, the fire fighting tool of the present invention is shown generally at 10 for making a hole 12 in a ceiling 14.

The configuration of the fire fighting tool 10 can best be seen in FIG. 2, which is an enlarged diagrammatic perspective view of the area generally enclosed by the dotted curve identified by ARROW 2 in FIG. 1 of the present invention, and as such, will be discussed with reference thereto.

The fire fighting tool 10 comprises a body 16 having a first terminal end 18 and a second terminal end 20.

The fire fighting tool 10 further comprises a hook 22 having a working area and disposed on the first terminal end 18 of the body 16 for piercing the ceiling 14 so as to form a piercing.

The fire fighting tool 10 further comprises a handle 24 pivotally mounted to the second terminal end 20 of the body 16.

The handle 24 has a normal position in which it extends perpendicularly outwardly from both sides of the body 16 to assist in the piercing.

The body 16 is straight, slender, elongated, and cylindrically-shaped.

The hook 22 has a first portion 26 that is straight and extends continuously, coaxially, and taperingly from the first terminal end 18 of the body 16 to a first point 28 for initially piercing the ceiling 14.

The first portion 26 of the hook 22 has longitudinal edges 30 that are straight and sharp for facilitating piercing of the ceiling 14.

The hook 22 further has a second portion 32 that is straight and depends continuously and taperingly from the first point 28 of the first portion 26 of the hook 22 to a second point 34.

The second point 34 of the second portion 32 of the hook 22 is disposed below the first terminal end 18 of the body 16.

The second portion 32 of the hook 22 depends away from the first portion 26 of the hook 22 at an acute angle α relative thereto so as to widen the working area of the hook 22.

The second portion 32 of the hook 22 has longitudinal edges 36 that are straight and sharp for further facilitating piercing of the ceiling 16.

The body 16 further has a fork 38 that depends coaxially from the second terminal end 20 thereof.

The handle 24 is pivotally mounted in the fork 38 of the body 16.

The handle 24 is formed of a continuous loop 40 that is slender, elongated, and has a midpoint 42.

The handle 24 further has a pair of cross members 44 that extend laterally across the continuous loop 40 of the handle 24 and straddle the midpoint 42 of the handle 24 so as to prevent collapsing of the continuous loop 40 of the handle 24.

The pair of cross members 44 of the handle 24 are flat.

The handle 24 further has a pivot pin 46 that extends through the fork 38 of the body 16 and the midpoint 42 of the continuous loop 40 of the handle 24.

The handle 24 further has a coil spring 48 that is wound around the pivot pin 46 of the handle 24 and which has a pair of free ends 50.

One free end of the pair of free ends 50 of the coil spring 48 abuts against one cross member of the pair of cross members 44 of the handle 24 and the other free end of the pair of free ends 50 of the coil spring 48 abuts against the body 16.

It will be understood that each of the elements described above or two or more together may also find a useful application in other types of constructions differing from the types described above.

While the invention has been illustrated and described as embodied in a fire fighting tool for making a hole in a ceiling however it is not limited to the details shown since it will be understood that various omissions, modifications, substitutions, and changes in the forms and details of the device illustrated and its operation can be made by those skilled in the art without departing in any way from the spirit of the present invention.

Without further analysis the foregoing will so fully reveal the gist of the present invention that others can by applying current knowledge readily adapt it for various applications without omitting features that from the standpoint of prior art fairly constitute characteristics of the generic or specific aspects of this invention.

The invention claimed is:

1. A fire fighting tool for making a hole in a ceiling, comprising:

a) a body having a first terminal end and a second terminal end;

b) a hook having a working area and disposed on said first terminal end of said body for piercing the ceiling so as to form a piercing; and c) a handle pivotally mounted to said second terminal end of said body and having a normal position in which it extends perpendicularly outwardly from both sides of said body to assist in the piercing;

wherein said body further has a fork that depends coaxially from said second terminal end thereof; and wherein said handle is pivotally mounted in said fork of said body.

2. The tool as defined in claim 1, wherein said body is straight, slender, elongated, and cylindrically-shaped.

3. The tool as defined in claim 1, wherein said hook has a first portion that is straight and extends continuously, coaxially, and taperingly from said first terminal end of said body to a first point for initially piercing the ceiling.

4. The tool as defined in claim 3, wherein said first portion of said hook has longitudinal edges that are straight and sharp for facilitating piercing of the ceiling.

5. The tool as defined in claim 3, wherein said hook further has a second portion that is straight and depends continuously and taperingly from said first point of said first portion of said hook to a second point.

6. The tool as defined in claim 5, wherein said second point of said second portion of said hook is disposed below said first terminal end of said body.

7. The tool as defined in claim 5, wherein said second portion of said hook depends away from said first portion of said hook at an acute angle relative thereto so as to widen said working area of said hook.

8. The tool as defined in claim 5, wherein said second portion of said hook has longitudinal edges that are straight and sharp for further facilitating piercing of the ceiling.

9. The tool as defined in claim 1, wherein said handle is formed of a continuous loop that is slender, elongated, and has a midpoint.

10. The tool as defined in claim 9, wherein said handle further has a pair of cross members that extend laterally across said continuous loop of said handle and straddle said midpoint of said handle so as to prevent collapsing of said continuous loop of said handle.

11. The tool as defined in claim 10, wherein said pair of cross members of said handle are flat.

12. The tool as defined in claim 10, wherein said handle further has a pivot pin that extends through said fork of said body and said midpoint of said continuous loop of said handle.

13. The tool as defined in claim 12, wherein said handle further has a coil spring that is wound around said pivot pin of said handle and which has a pair of free ends.

14. The tool as defined in claim 13, wherein one free end of said pair of free ends of said coil spring abuts against one cross member of said pair of cross members of said handle and the other free end of said pair of free ends of said coil spring abuts against said body.

* * * * *